US005195208A

United States Patent [19]

Yamami et al.

[11] Patent Number: 5,195,208

[45] Date of Patent: Mar. 23, 1993

[54] BACKPACK POWER BLOWER APPARATUS

[75] Inventors: Hirofumi Yamami, Akishima; Yoshisato Hashimoto; Giichi Iida, both of Tokyo; Shunsuke Nakadate, Hamura, all of Japan

[73] Assignee: Kioritz Corporation, Tokyo, Japan

[21] Appl. No.: 806,181

[22] Filed: Dec. 13, 1991

[30] Foreign Application Priority Data

Dec. 19, 1990 [JP] Japan ..... 2-400971[U]

[51] Int. Cl.[5] ..... A47L 9/00

[52] U.S. Cl. ..... 15/326; 15/327.5; 15/405

[58] Field of Search ..... 15/344, 405, 327.5, 15/326

[56] References Cited

U.S. PATENT DOCUMENTS 2,563,195 8/1951 Soule et al. .
3,308,608 3/1967 Brimberg ..... 15/327.5 X
3,539,110 11/1970 Kobayashi .
3,586,238 6/1971 Schmierer .
4,451,951 6/1984 Satoh .
4,595,142 6/1986 Kawaharazuka et al. .
4,748,712 2/1987 DiGiovanni .
4,872,308 10/1989 Nagai et al. .
4,895,114 1/1990 Iida et al. .
4,955,105 9/1990 Sunagawa et al. ..... 15/327.5 X
5,011,058 4/1991 Sapp et al. .
5,052,073 10/1991 Iida ..... 15/327.5

FOREIGN PATENT DOCUMENTS 1229333 6/1962 Fed. Rep. of Germany .
1048066 4/1963 Fed. Rep. of Germany .
1607396 8/1970 Fed. Rep. of Germany .

*Primary Examiner*—Chris K. Moore
*Attorney, Agent, or Firm*—Browdy and Neimark

[57] ABSTRACT

A backpack power blower apparatus including a frame carrying an engine and a blower. The frame is provided with a sound insulating planar member for reducing noises produced by the engine and the blower, the sound insulating planar member including opposite side portions extending rearwardly from a front portion of the frame and a rear portion extending between the opposite side portions at rear end portions thereof whereby the sound insulating planar member surrounds a machine body, including the engine and the blower, at least at opposite sides and a rear side of the machine body.

3 Claims, 4 Drawing Sheets

BACKPACK POWER BLOWER APPARATUS

BACKGROUND OF THE INVENTION

The present invention relates to a backpack power blower apparatus.

The backpack power blower apparatus, such as a power sprayer and a blower cleaner, is equipped with an engine as a power source on a backpack frame having a backplate. The frame is also provided with a blower driven by the engine. The cooling of the engine is commonly carried out by an air stream branched from the main stream of the blower. The noise caused by the cooling air is actually louder than the exhaust noise and the suction noise of the engine. To reduce noises, an attempt has been made to mount a noise insulation material to the backplate of the frame. The insulation effect is however still poor since noises produced due to both cooling air and the air stream from the blower leak to the outside from the sides of the frame from which cooling air and exhaust gases are discharged. Thus, the operator and the surroundings feel unpleasant.

SUMMARY OF THE INVENTION

Accordingly, it is an object of the present invention to provide a backpack power blower apparatus which is capable of reducing the drawback previously described with a relatively simple and a low cost construction.

In view of this and other objects, the present invention provides a backpack power blower apparatus comprising: a frame for carrying an engine, a blower and associated parts, the frame including a front portion to be carried on the back of an operator; and sound insulating planar means for reducing noises produced by the engine and the blower, the sound insulating planar means including opposite side portions extending rearwardly from the front portion of the frame, and a rear portion extending between the opposite side portions at rear end portions thereof, whereby the sound insulating planar means surrounds a machine body, including the engine and the blower, at least at the opposite sides and the rear side of the machine body.

With such a construction, the present invention is capable of effectively decreasing the level of noises which are emitted from the engine and the blower mounted on the frame in all lateral directions, so that displeasure which is to be provided to the operator and the neighbors is fairly reduced. The noise insulating mechanism according to the present invention is relatively simple in construction and is hence advantageous in cost.

DETAILED DESCRIPTION OF PREFERRED EMBODIMENTS

Figure 1:
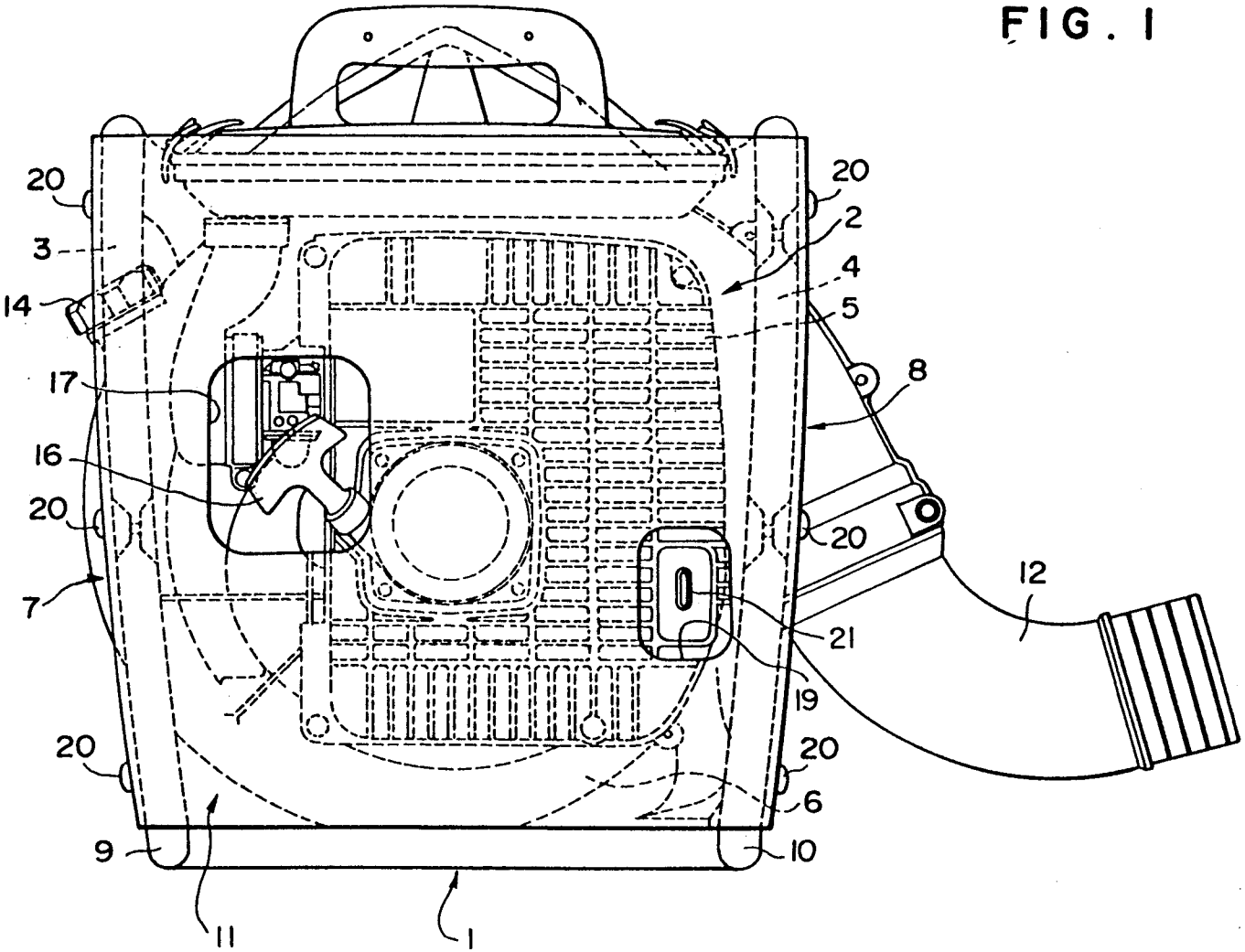
FIG. 1 is a rear view of a backpack power blower cleaner as one embodiment of the present invention.
Figure 2:
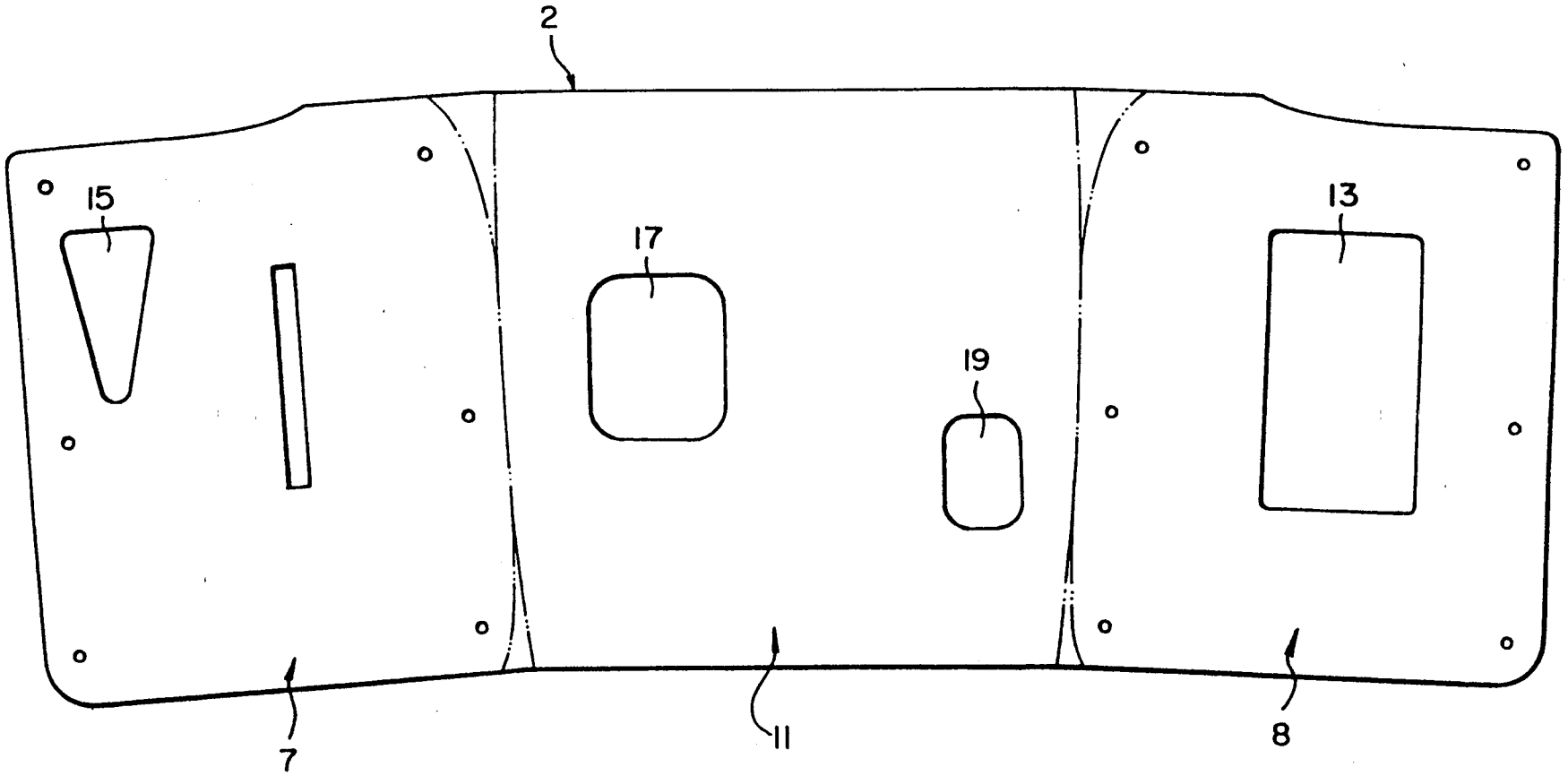
FIG. 2 is an unfolded view of the noise insulation sheet of FIG. 1.
Figure 3:
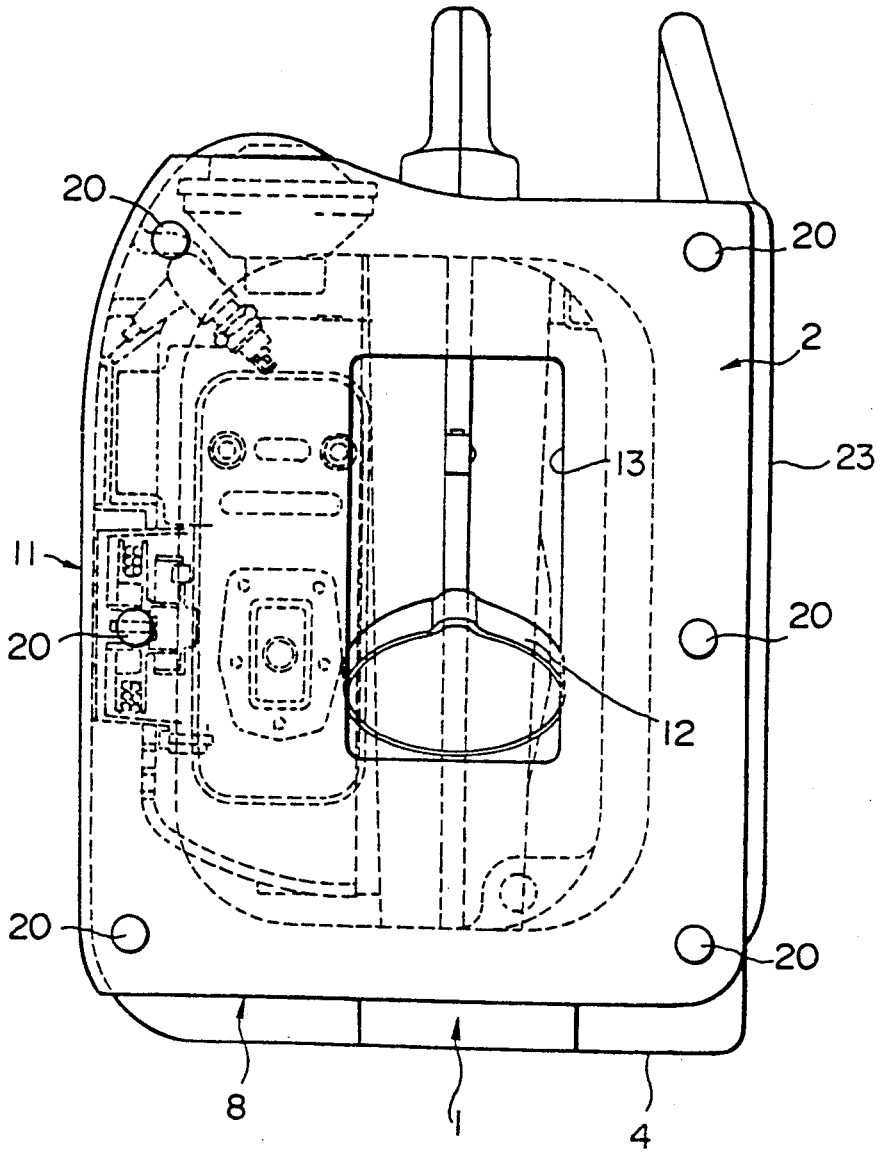
FIG. 3 is a side view of the backpack power blower cleaner of FIG. 1.

One embodiment of the present invention will be described with reference to the drawings. FIGS. 1 to 3 illustrate a backpack power blower cleaner according to the present invention, in which a frame 1 has a flexible noise insulation sheet 2 mounted to it. The frame 1 includes a front portion 23 to be carried on the back of an operator. A pair of parallel side subframes 3 and 4 are integrally formed with the front portion 23 at opposite sides thereof to extend rearwardly. The front portion 23 and the side subframes 3 and 4 define a channel-shaped recess, in which a machine body including an air-cooled two cycle engine 5, a blower 6 driven by the engine 5 and associated components is provided. The flexible noise insulation sheet 2 includes a pair of side portions 7 and 8 and a rear portion 11 connecting the side portions 7 and 8. The side portions 7 and 8 are mounted over respective side subframes 3 and 4 of the frame that the rear portion 11 of the flexible noise insulation sheet 2 extends between rear end portions 9 and 10 of the side subframes 3 and 4 to close the rear opening of the channel-shaped recess as clearly shown in FIG. 1. Thus, the machine body is surrounded with the flexible noise insulation sheet 2 except the top an bottom thereof and the portion covered by the front portion 23 of the frame 1. The flexible noise insulation sheet 2 is made of a relatively thin flexible material, such as an about 3 mm thick rubber sheet. The flexible noise insulation sheet 2 is provided in the right side portion 8 with an opening 13 for passing the blowout tube 12 of the blower 6. The flexible noise insulation sheet 2 has further openings 15, 17 and 19. The openings 15 and 17 allow a pouring port 14 of a fuel tank and an operating knob 16 of a recoil starter of the engine 5 to pass through, respectively. The opening 19 allows the exhaust port 21 of the engine 5 to expose to the outside. The flexible noise insulation sheet 2 is removably attached to the side subframes 3 and 4 of the frame 1 and other parts through fasteners 20, such as snaps.

The flexible noise insulation sheet 2 thus attached to the side subframes 3 and 4 of the frame 1 effectively reduces the level of noises which have been produced from the engine 5 and the blower 6 and emitted through the side subframes 3 and 4 and the rear side of the frame 1, so that displeasure of the operator and the neighbors is fairly reduced. In an experiment in which an about 3 mm thick rubber plate was used as the flexible noise insulation sheet 2, it was confirmed that the mean level of the noises measured at eight positions at regular angular intervals around and about 15 m away from the apparatus was smaller by 2 dB(A) than the mean level in the case where the flexible noise insulation sheet 2 was removed.

In this embodiment, the top and the bottom of the apparatus are exposed to the atmosphere, and hence the cooling effect of the engine is fairly increased by making use of a draft effect.

Figure 4:
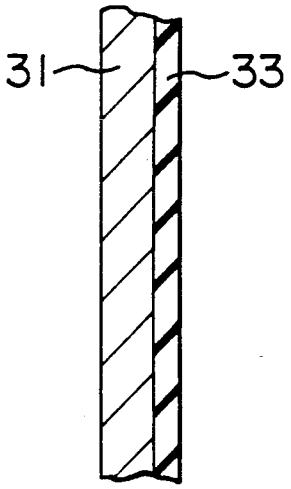
FIG. 4 is a fragmental enlarged vertical section of a modified form of the noise insulation sheet of FIG. 1.

The flexible noise insulation sheet 2 may be replaced by a hard plate 31 of aluminum which is lined with a conventional sound absorbing material 33 such as a rubber as shown in FIG. 4. The hard plate 3 may be of the same shape as the sound insulating sheet 2. Alternatively, the side subframes 3 and 4 of the frame 1 may be plate members of the same shape of the sound insulating sheet 2 and made of a conventional sound insulating material.

What is claimed is:

1. A back power blower apparatus comprising:

a frame for carrying an engine, a blower and associated parts, said frame including a front portion to be carried on the back of an operator;

sound insulating means for reducing noises produced by the engine and the blower, said sound insulating means having a flexible sheet including opposite side portions extending rearwardly from said front portion of the frame, and a rear portion extending between said opposite side portions whereby said sound insulating means surrounds a machine body, including the engine and the blower, at least at the opposite sides and the rear side of the machine body.

2. A backpack power blower apparatus as recited in claim 1 wherein said sound insulating means comprises openings to allow parts of the machine body to protrude there through.

3. A backpack power blower apparatus as recited in claim 1, wherein said sound insulating means further comprises a solid plate member having said flexible sheet lining over said solid plate member, said solid plate member including opposite side portions extending rearwardly from said front portion of the frame, and a rear portion extending between said opposite side portions.

* * * * *